United States Patent [19]

Boren

[11] 4,050,577

[45] Sept. 27, 1977

[54] REFRACTORY STRUCTURE AND METHOD

[75] Inventor: John A. Boren, Greensboro, N.C.

[73] Assignee: North State Pyrophyllite Company, Greensboro, N.C.

[21] Appl. No.: 686,929

[22] Filed: May 17, 1976

Related U.S. Application Data

[63] Continuation of Ser. No. 393,947, Sept. 4, 1973, abandoned.

[51] Int. Cl.[2] ..... B65D 85/46; B65D 65/00

[52] U.S. Cl. ..... 206/322; 206/386; 206/497; 108/53.1

[58] Field of Search ..... 206/321, 322, 386, 497; 108/51, 52, 57, 58

[56] References Cited

U.S. PATENT DOCUMENTS

| | | | |
|---|---|---|---|
| 2,443,202 | 6/1948 | Smith | 206/386 |
| 3,189,175 | 6/1965 | Cruckshank | 206/386 |
| 3,368,670 | 2/1968 | Weaver | 206/322 |
| 3,638,790 | 2/1972 | Schmid | 206/386 |

*Primary Examiner*—William Price
*Assistant Examiner*—Douglas B. Farrow

[57] ABSTRACT

This invention relates to the preparation and packaging of refractory blocks into prefabricated panel units for transportation to a site, a refractory wall constructed of the prefabricated units and the method of forming a wall. The blocks, in a panel unit, are supported upon a pallet, enclosed by a relatively moisture-tight wrapper, and bound to a structure for lifting the stack of blocks. The panel units are adapted to be positioned in abutting relation, lateral and vertical, with each other and preferably include wedge-shaped blocks at prescribed locations for facilitating erection of a wall adjacent a support structure.

5 Claims, 7 Drawing Figures

REFRACTORY STRUCTURE AND METHOD

This is a continuation of application Ser. No. 393,947, filed 4 Sept. 1973 now abandoned.

BRIEF SUMMARY AND OBJECTS OF THE INVENTION

Refractory walls, formed of blocks or slabs of refractory material, have been constructed in various ways to form substantially monolithic wall constructions. Conventional practices are disclosed, for example, in U.S. Pat. Nos. 3,606,722; 1,983,590 and 2,120,133 wherein the plastic blocks of slabs are individually laid in tiers and courses and rammed into place. Copending U.S. patent application Ser. No. 196,831, filed 8 Nov. 1971, discloses a mortarless joint refractory structure and method wherein massive plastic blocks are individually positioned against each other to form a wall while maintaining the individual integrity of each block, and upon exposure to high temperatures expand into a substantially monolithic wall. Such conventional wall construction practices are tedious, time consuming and costly.

The present invention relates to a refractory structure and method whereby wall panel units are prefabricated, shipped to a desired location and positioned adjacent a permanent supporting structure.

The wall units are formed by stacking a plurality of refractory blocks upon a pallet, wrapping the stack of blocks, positioning a structure upon the wrapped stack of blocks and binding the wrapped blocks to the lifting structure. A plurality of panel units may be supported upon a single pallet. Reinforcing pads may be provided at the corners of the stack of blocks underneath the block binding straps.

In a preferred embodiment, the stack of blocks consists of pliable, unfired plastic blocks and with at least some fired blocks selectively positioned at least at the corners of the stack. The fired blocks, particularly at the uppermost corners of each panel unit, are wedge-shaped and define apertures for receiving wall anchor members.

The wall units are stacked in side-by-side and above each other relationship, after removal of the lifting structures, to form a wall. Anchor members may be provided intermediate the stacks of blocks for tying units to a support structure.

In a preferred embodiment, the plastic blocks are formed from a mixture of crushed raw pyrophyllite and plastic clay, the pyrophyllite having a range from 10% to 75% by weight. Pyrophyllite has been recognized as an excellent refractory material mined as a crystalline mineral coming within the rhombic or monoclinic system. Chemically, pyrophyllite is a hydrous alumina silicate. Mechanical water in the blocks may be driven off at approximately 250° F and the blocks expand upon being subjected to high temperatures preventing voids and spaces between the stacked blocks.

One of the primary objects of the invention is the provision of a new and improved system for forming prefabricated wall panel units from a plurality of blocks, packaging the panel units for transport to a desired location, and stacking of the individual panel units to form a wall.

Another object of the invention is the provision of a new and improved refractory wall system which eliminates undue labor cost and excessive handling of the blocks.

A further object of the invention is the provision of a new and improved method of securing a plurality of wall units to each other to form a permanent support structure.

Still another object of the invention is the provision of a new and improved refractory block package and the method of transporting such package.

Other objects and advantages of the invention will become apparent when considered in view of the following detailed description.

DETAILED DESCRIPTION OF THE INVENTION

Figure 1:
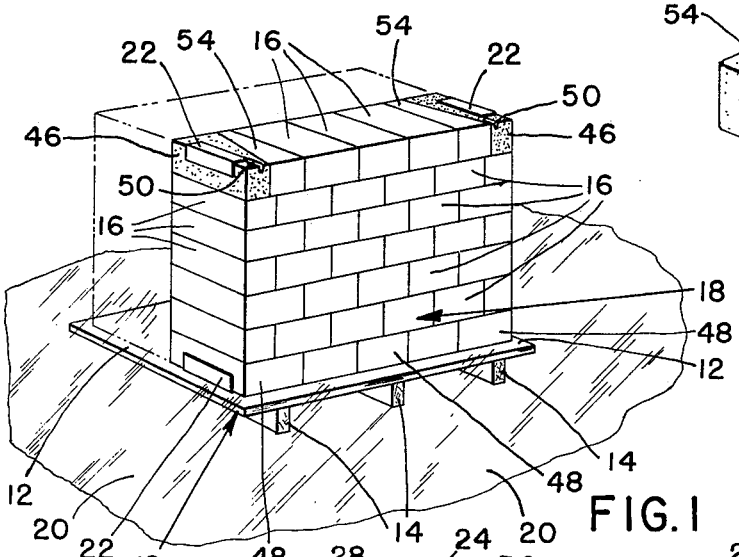
FIG. 1 is a perspective view of a first panel unit defined by a stack of refractory blocks positioned upon a pallet and adapted to be enclosed by a cover.

Referring to the drawing, FIG. 1 illustrates a conventional pallet 10 comprising a deck 12 and three spaced runners 14, the deck 12 having blocks 16 positioned thereon. The blocks are formed of a plastic refractory material which is rather stiff and yet pliable, such as disclosed in copending U.S. Patent application Ser. No. 196,831 and U.S. Pat. No. 3,606,722. The blocks 16 are rather large measuring, for example, approximately 18 inches by 9 inches by 5 inches. While the size and number of blocks 16 positioned upon the pallet 10 may vary, the blocks of FIG. 1 represent one practical unit or panel 18. A typical unit 18 may weigh approximately 2500 pounds. The blocks 16 are positioned in abutting side by side, above each other relationship preferably with the blocks of adjacent courses being in staggered relation.

Before individually stacking the blocks 16 upon the pallet 10, a covering 20 which may be transparent plastic flexible sheet material such as polyethylene is placed to cover the pallet deck 12. After stacking the desired number of blocks to form one unit upon the pallet, the sheet material is wrapped about the block unit 18 to seal the unit. The covering 20 prevents undue evaporation of moisture from the relative rigid plastic blocks 16. Some moisture is preferably retained in the blocks to maintain the desired range of workability of the plastic blocks and to facilitate the formation of a substantially monolithic wall.

Figure 2:
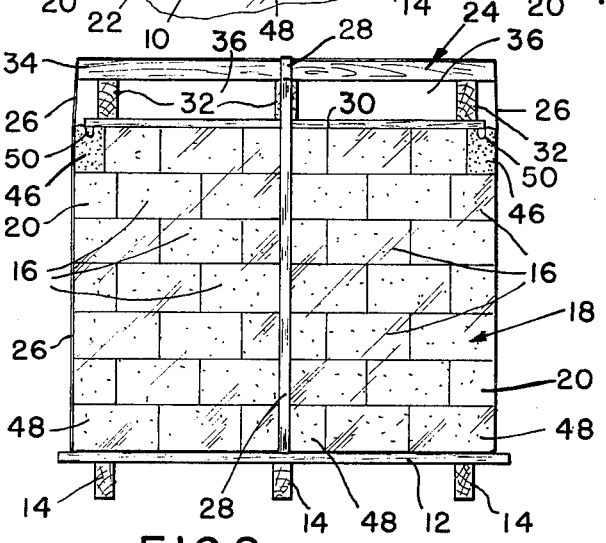
FIG. 2 is a front elevational view of a pallet having a refractory block package supported thereon, said blocks being enclosed in a cover and bound by straps to a lifting structure.
Figure 3:
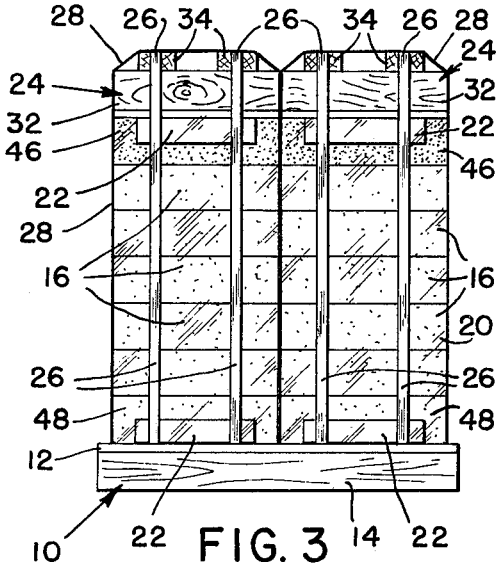
FIG. 3 is a side elevational view of a package having two refractory block packages supported thereon.

Corner pads or reinforcing members 22, FIGS. 1-3, may be provided, if desired, at the corner blocks of the panel unit 18. The members 22 are constructed of various suitable materials sufficiently rigid to prevent damage to the blocks when the entire unit 18 is lifted from the pallet 10 and may be angle iron or multiple corrugated angle pads.

A structure 24 then is positioned upon the stack of blocks and attached thereto by straps or bands 26, 28. The bands 26, 28 extend transversely and longitudinally of the block unit 18 being completely around the unit 18 and the structure 24. The bands 26, 28 may be positioned upon the pallet deck 12 before positioning of the flexible plastic material upon the pallet and before stacking of the blocks thereon. It is to be noted that the parallel bands 26 engage the corner pads 22. The structure 24 includes a flat plate 30, which engages the uppermost edges of the top layer of blocks of a panel unit 18, a plurality of spaced parallel runners 32 secured to plate 30, and a plurality of parallel runners 34 extending transversely of and secured to the runners 32. The structure 24 defines openings 36, FIG. 2, for receiving the tines of a fork lift truck or other suitable lifting means. Therefore, the structure 24 being bound to the block unit 18 serves as a means to lift the unit 18 from a pallet 10 and position the unit at a selected location. It is to be noted that the pallet 10 illustrated is of such a size to support two block panel units 18 thereon, as shown by FIGS. 1 and 3. Also, the flat plate 30 is narrower than the width of the blocks to permit stacking of the units in side-by-side relation with the blocks of the units abutting.

Figure 4:
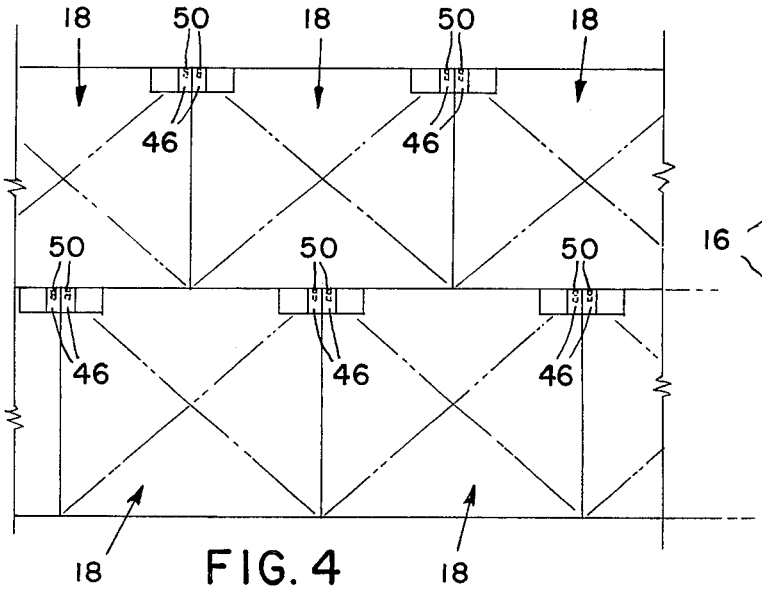
FIG. 4 is a schematic, elevational view of a plurality of stacked panel units forming a wall and illustrating the blocks for facilitating anchoring of the units to a permanent support structure.
Figure 7:
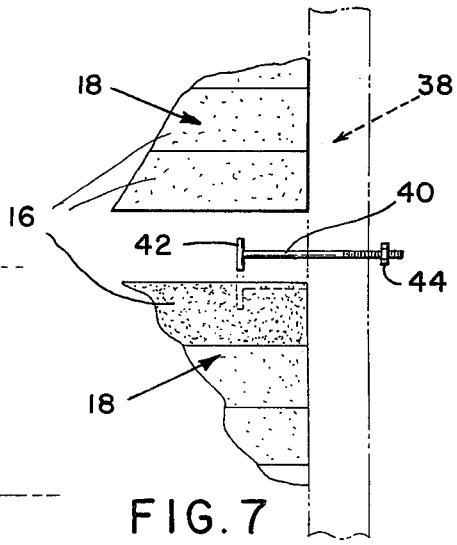
FIG. 7 is a fragmentary, side elevational view of a pair of vertically stacked panel units and an anchor member adapted to be attached to both units in a support structure.

A plurality of panel units 18 may be packaged, as shown by FIG. 3, and transported to a desired location upon pallet 10. At the site where the refractory wall is to be constructed, the units are individually lifted from the pallets by a fork lift truck, or other suitable means, and the units 18 positioned in abutting side-by-side and above each other relationship as shown schematically in FIG. 4. After each unit is properly positioned, the bands 26, 28 are cut and the exposed band portions removed along with the structure 24. The unexposed portions of the bands and the covering 20 remain upon the unit, if desired. The covering 20 will be consumed upon firing of the furnace. After removal of the lifting structure 24, the unit 18 is adapted to have another unit positioned thereon. The units may be secured, if desired, to a supporting structure 38 by means of anchors 40. The anchor 40 of FIG. 7 has a threaded portion which extends through supporting structure 38 and a T-shaped end portion 42 which is adapted to be embedded within blocks 16 of two units 18. A nut 44 fastens the anchor 40 to the structure 38.

Figure 5:
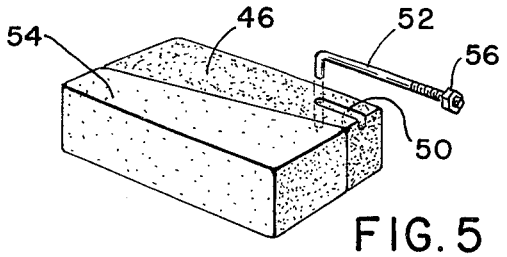
FIG. 5 is a perspective view of a plurality of refractory blocks at the uppermost corner of a stack of blocks defining a panel unit, the top outermost blocks being wedge-shaped and illustrating the manner of attaching an anchor member to one of the wedge-shaped blocks.
Figure 6:
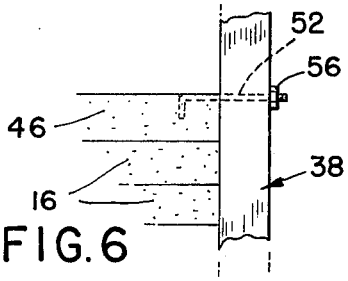
FIG. 6 is a fragmentary, side elevational view of a panel unit and support structure and the means for securing the unit to the support structure.

In most instances it may be desirable to provide hardened, fired blocks at selected locations throughout the stack of blocks of a unit 18. As shown most clearly by FIGS. 1, 2 and 5, fired blocks 46 and 48 have been provided in the uppermost and lowermost courses of the unit 18 for maintaining the integrity of the unit blocks during lifting and transporting of the unit. In the preferred embodiment, full size fired blocks 48 have been provided at the ends and intermediate the lower course of the stack of blocks in the unit 18. The fired blocks 46 at the corners of the uppermost course of blocks preferably are wedge-shaped, as shown by FIGS. 1, 2 and 5. The blocks 46 may be fired with apertures 50 therein. Generally L-shaped anchors 52, FIG. 5, are adapted to be received within the apertures 50 for facilitating bolting of the fired blocks 46 of a block unit 18 to a support structure 38, as shown by FIG. 6.

The plastic blocks 54 immediately beside the fired, wedge-shaped blocks 46 also are necessarily wedge-shaped. Upon positioning of the T units 18 in side-by-side relation with adjacent blocks of the units in abutting relation, the units 18 may be wedged together by tightening the nuts 56 of anchors 52 thereby shifting the fired wedge-shaped blocks 46 transversely of the wall thereby binding together selected courses of abutting block units 18.

When a furnace enclosed by the wall or walls formed by units 18 is fired, the plastic blocks of the unit harden into a substantially monolithic wall which may be held in place by anchors 52 and/or 40.

I claim:

1. A package containing refractory blocks for transportation to a desired location for forming a monolithic wall comprising: a base support means, a plurality of massive plastic refractory blocks stacked on said support means, certain of said blocks being fired, and other blocks being unfired, a pair of complementary wedge shaped blocks, being located at each corner of the top of the stacked blocks, at least the outer of said pair being a fired block, lifting means being supported by said blocks, corner reinforcing means positioned to engage said fired blocks, and binding means surrounding said blocks and said lifting means whereby said blocks and said lifting means are rigidly united by said binding means, said pairs of blocks being located so as to urge the top of said stacked blocks into stacked alignment.

2. A package containing refractory blocks for transportation to a desired location as claimed in claim 1, wherein said wedge-shaped blocks define apertures for receiving anchoring means.

3. A package of refractory blocks for transportation to a desired location as claimed in claim 1, and further including cover means encompassing said blocks.

4. A package of refractory blocks for transportation to a desired location as claimed in claim 1, wherein said plastic blocks consist of pyrophyllite and plastic clay.

5. A package of refractory blocks as receited in claim 1, and further including a second plurality of blocks on said base support bound to a second panel lifting means independently of the first named plurality of blocks and panel lifting means.

* * * * *